United States Patent [19]

Silber

[11] Patent Number: 4,823,786

[45] Date of Patent: Apr. 25, 1989

[54] BREATHING EQUIPMENT FOR PROVIDING PROTECTION AGAINST DROWNING, IN PARTICULAR FOR THE DRIVER OF A MOTORIZED WATER VESSEL

[75] Inventor: Gérard Silber, Chilly-Mazarin, France

[73] Assignee: Societe de Fabrication d'Instruments de Mesure (S.F.I.M.), Massy Cedex, France

[21] Appl. No.: 175,712

[22] Filed: Mar. 31, 1988

[30] Foreign Application Priority Data

Apr. 2, 1987 [FR] France ..... 87 04626

[51] Int. Cl.[4] ..... A68B 7/02; B63C 11/18

[52] U.S. Cl. ..... 128/202.27; 128/204.29; 128/202.12; 128/205.24

[58] Field of Search ..... 128/202.13, 202.14, 128/202.27, 204.29, 205.24

[56] References Cited

U.S. PATENT DOCUMENTS

| | | | |
|---|---|---|---|
| 2,329,289 | 4/1943 | Morehouse | 128/202.13 |
| 2,482,292 | 9/1949 | Sabbia | 128/202.27 |
| 2,835,251 | 5/1958 | Oliveau | 128/202.27 |
| 3,185,148 | 5/1965 | Gaylord | 128/202.27 |
| 3,362,420 | 1/1968 | Blackburn et al. | 128/205.24 |
| 3,521,627 | 7/1970 | Murray | 128/202.27 |
| 3,892,234 | 7/1975 | Jones | 128/202.13 |
| 4,060,076 | 11/1977 | Botos et al. | 128/204.29 |
| 4,688,565 | 8/1987 | Kobayashi | 128/205.24 |

*Primary Examiner*—Edgar S. Burr
*Assistant Examiner*—Kimberly L. Asher

[57] ABSTRACT

Equipment for providing protection against drowning, in particular for use by the driver of a motorized water vessel, the equipment comprising:

a supply (110) of air under pressure, feeding a regulating pressure expander (130, 140);

a face mask (210) including a breathe-in valve (211) and a breathe-out valve (212); and switch means (160) for selectively connecting the breathe-in valve of the face mask either to the regulating pressure expander or else to the atmopshere, said switch means being constituted by an electrically controlled valve permanently powered via a safety inertia switch, such that the breathe-in valve of the face mask is connected to the surrounding air so long as the electrically controlled valve is fed with electricity, and that in the event of the inertia switch interrupting the supply of electricity to the electricity controlled valve, because of the vessel being subjected to a shock, the breathe-in valve of the face mask is immediately switched to the regulating pressure expander.

4 Claims, 1 Drawing Sheet

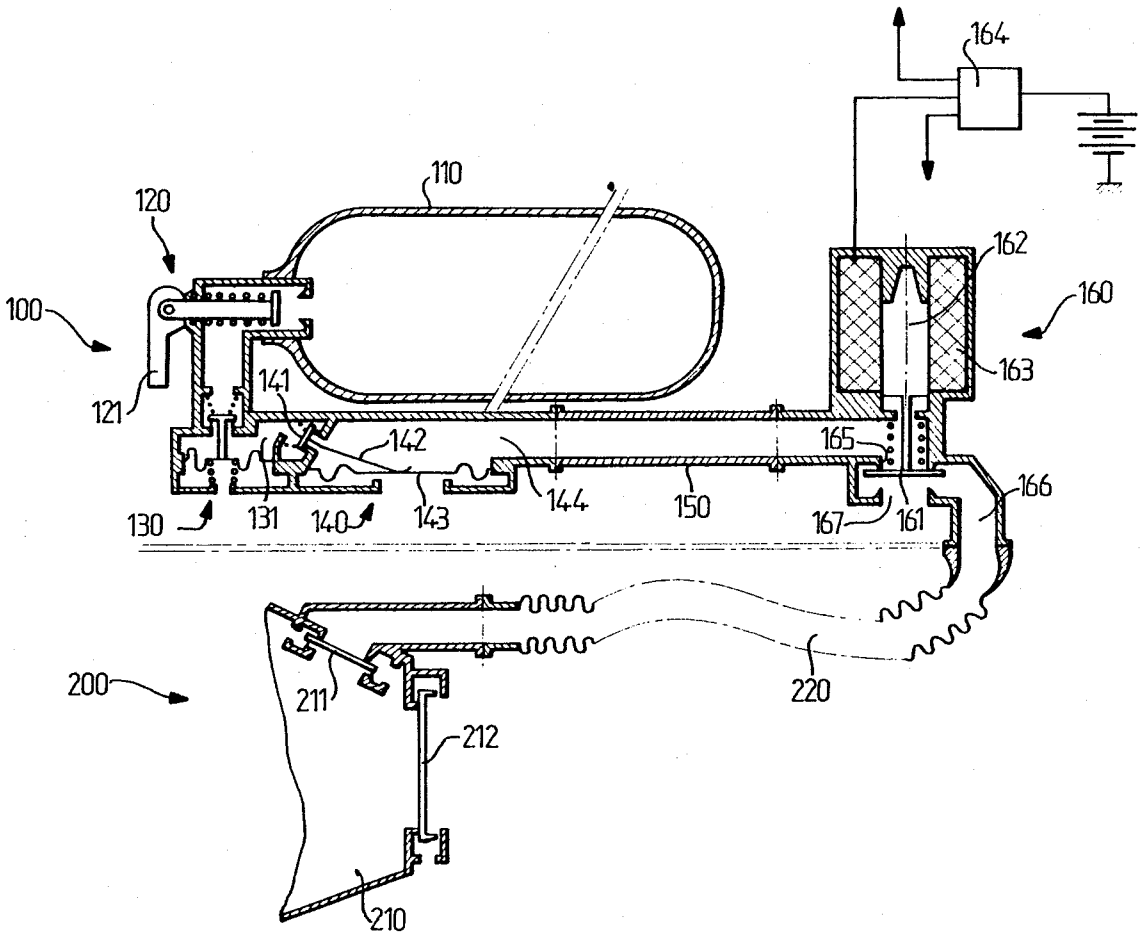
100
110
120
121
130
131
140
141
142
143
144
150
160
161
162
163
164
165
166
167
200
210
211
212
220

BREATHING EQUIPMENT FOR PROVIDING PROTECTION AGAINST DROWNING, IN PARTICULAR FOR THE DRIVER OF A MOTORIZED WATER VESSEL

The present invention relates to equipment for providing protection against drowning, in particular for the driver of a motorized water vessel.

BACKGROUND OF THE INVENTION

In modern competitive speed boats, the driver is seated in a bucket seat and is strapped into place, with the seat being situated in an undeformable zone of the boat structure.

Thus, conventional life-buoy and life-vest systems are not usable, since the driver does not have time to release himself from the seat, or may be incapable of doing so because of unconsciousness.

Numerous equipments are known for providing protection for the pilots of aircraft in the event of incidents at high altitude, as described, for example, in U.S. Pat. Nos. 3,189,027 and 4,651,728. These equipments are not suitable for providing protection against drowning.

Finally, equipments are known for protecting persons required to go into toxic atmospheres (see for example British Pat. No. 2,045,090). Hereagain the equipments are not suitable for immersion of the wearer in water.

One of the objects of the invention is to provide a device which is deployed completely automatically and which serves to protect the driver against drowning in the event of total or partial immersion, and to provide self-contained survival breathing while waiting to be rescued.

SUMMARY OF THE INVENTION

To this end, the present invention provides equipment for providing protection against drowning, in particular for use by the driver of a motorized water vessel, said equipment comprising:

a supply of air under pressure, feeding a regulating pressure expander;

a face mask including a breathe-in valve and a breathe-out valve; and switch means for selectively connecting the breathe-in valve of the face mask either to the regulating pressure expander or else to the atmosphere, said switch means being constituted by an electrically controlled valve permanently powered via a safety inertia switch, such that the breathe-in valve of the face mask is connected to the surrounding air so long as the electrically controlled valve is fed with electricity, and that in the event of the inertia switch interrupting the supply of electricity to the electrically controlled valve, because of the vessel being subjected to a shock, the breathe-in valve of the face mask is immediately switched to the regulating pressure expander.

Such an inertia switch is already provided in modern motorized water vessels, for the purpose of electrically switching off the engine in the event of the vessel striking another vessel or a fixed obstacle.

In addition to providing such dynamic protection, the equipment of the invention also serves to prevent the driver from drowning in the event of the cabin overturning.

According to another advantageous feature of the invention the expander is preferably a two-stage compensated expander: this makes it possible to provide satisfactory pulmonary ventilation not only in the event of shallow immersion (vessel overturned), but also in the event of immersion to a greater depth (several meters).

BRIEF DESCRIPTION OF THE DRAWINGS

An embodiment of the invention is described, by way of example, with reference to the sole FIGURE of the accompanying drawing which is a diagrammatic view of a set of items making up equipment in accordance with the invention.

MORE DETAILED DESCRIPTION

In the FIGURE, reference numeral 100 generally designates items which are fixed to the bucket seat or to the undeformable structure of the driver's cabin; while reference numeral 200 designates individual equipment which is fixed by a headband to the driver's face.

Assembly 100 comprises a cylinder of breathable air 110, e.g. a volume of 300 liters of air under conditions of normal temperature and pressure (capable of ensuring survival for about 15 minutes, which is long enough for rescue to arrive), fitted with a master cock 120 for putting it into communication with a two-stage pressure reducing valve and regulator 130, 140.

The first stage 130 of the valve serves to reduce the high pressure inside the cylinder (several tens of bars) to a value of a few bars in a chamber 131.

The second stage 140 includes a non-return valve 141 connected by a control rod 142 to a compensating diaphragm 143: these items serve to deliver air to a chamber 144 situated downstream therefrom at a pressure which is equal to the pressure on the outside face of the diaphragm 143.

The chamber 144 is put into communication via a duct 150 with an electrically controlled valve 160. This valve comprises a valve plate 161 fixed to a plunger core 162 which is displaced under the control of a winding 163. The winding 163 is connected to the positive terminal of the vessel's power supply, via an inertia switch 164.

In the normal position, the switch 164 applies a permanent feed to the electrically controlled valve, thereby pressing the valve plate 161 against its seat 165 and completely closing the outlet from the pressure reducer 130, 140, such that no compressed air is delivered thereby.

In contrast, in the event of a violent shock, the inertia switch 164 will open, thereby de-exciting the electrically controlled valve and thus opening the valve plate 161, causing compressed air to be delivered to an outlet duct 166.

The duct 166 is connected to a face mask 210 for breathing purposes via a flexible hose 220, such that the mask is supplied with air either from the above-described compressed air delivery system (when the electrically controlled valve is in the "rest" position) or else via an orifice 167 for providing communication with the outside air (when the valve is in the "working" position), said orifice 167 being closed when the valve is in the "rest" position.

The mask 210 is a conventional type of mask as used in aircraft, having a breathe-in valve 211 connected to the hose 220 and a breathe-out valve 212 connecting the internal volume of the mask to the surrounding atmosphere.

The operation of this equipment is now described.

Before departure, the driver opens the master cock 120 by acting on the handle 121 and switches on the electrical power supply to the valve 160 by switching on the vessel's inertia protection system.

The valve plate 161 then moves into its "working" position which releases the orifice 167 and allows outside air to reach the mask 210. Each time the driver breathes in, suction is set up in the mask causing the breathe-in valve 211 to open and allowing air to enter the mask from the orifice 167 of the valve 160. The driver inhales this air, and on breathing out, said breathe-in valve 211 closes while the breathe-out valve 212 opens until the end of exhalation, and the beginning of the next breathing cycle.

In the event of an accident, the vessel's inertia detector 164 switches off the power supply to the electrically controlled valve 160, thereby causing its valve plate 161 to move to the "rest" position, i.e. to close the orifice 167. From this moment on, the bottle-expander-valve-mask system keeps out external water, i.e. even if the driver is completely submerged, water cannot penetrate into his respiratory passages.

Each time the driver breathes in, air reaches the mask by the breathe-in valve 211 opening, thereby feeding fresh air to the mask from the valve 141 at the same pressure as the pressure applied to the membrane 143.

Whenever the driver breathes out, the valve 211 closes and the breathe-out valve 212 opens.

If submerged to a greater depth (for example 5 meters), the pressure at this depth acts on the membrane 143 of the second stage 140 of the expander causing air to be delivered at the same pressure as that being applied to the outside face of the membrane 143. The breath-in valve 211 opens and the breathe-out valve 212 closes until the driver breathes out again. At this point the system remains static without any flow of air through the system until the driver breathes in again.

When the driver next breathes in, air is delivered on request until equilibrium pressure is re-established in the mask. On breathing out, the breathe-in valve 211 closes and the inside of the mask is at a higher pressure than the outside pressure, thereby causing the breathe-out valve to open which will close again next time the driver breathes in.

Advantageously, a compensated breathe-out valve 212 is provided, to enable breathing to take place with a slight excess pressure in order to force pulmonary ventilation of the driver.

I claim:

1. Equipment for providing protection against drowning, in particular for use by the driver of a motorized water vessel, the equipment comprising:

a supply of air under pressure, feeding a regulating pressure expander;

a face mask including a breathe-in valve and a breathe-out valve; and switch means for selectively connecting the breathe-in valve of the face mask either to the regulating pressure expander or else to the atmosphere, said switch means being constituted by an electrically controlled valve permanently powered via a safety inertia switch, such that the breathe-in valve of the face mask is connected to the surrounding air so long as the electrically controlled valve is fed with electricity, and that in the event of the inertia switch interrupting the supply of electricity to the electrically controlled valve, because of the vessel being subjected to a shock, the breathe-in valve of the face mask is immediately switched to the regulating pressure expander.

2. Equipment according to claim 1, wherein the regulating pressure expander comprises a two-stage compensated expander.

3. Equipment according to claim 1 wherein the breathe-in valve of the face mask is a compensated valve enabling breathing to take place at a small excess pressure, thereby forcing pulmonary ventilation of the wearer of the mask.

4. Equipment according to claim 2 wherein the breathe-out valve of the face mask is a compensated valve enabling breathing to take place at a small excess pressure, thereby forcing pulmonary ventilation of the wearer of the mask.

* * * * *